US005956054A

United States Patent [19]

Hirabayashi et al.

[11] Patent Number: 5,956,054

[45] Date of Patent: Sep. 21, 1999

[54] INK JET RECORDING APPARATUS INCLUDING A RECORDING HEAD WITH INCLINED EJECTION OUTLETS

[75] Inventors: Hiromitsu Hirabayashi, Yokohama; Atsushi Arai, Kawasaki; Hiroshi Tajika; Noribumi Koitabashi, both of Yokohama, all of Japan

[73] Assignee: Canon Kabushiki Kaisha, Tokyo, Japan

[21] Appl. No.: 08/956,496

[22] Filed: Oct. 22, 1997

Related U.S. Application Data

[63] Continuation of application No. 08/478,095, Jun. 7, 1995, abandoned, which is a continuation of application No. 08/087,111, Jul. 1, 1993, abandoned, which is a continuation of application No. 07/857,120, Mar. 24, 1992, abandoned, which is a continuation of application No. 07/648,059, Jan. 30, 1991, abandoned.

[30] Foreign Application Priority Data

Feb. 2, 1990 [JP] Japan ..... 2-22194

[51] Int. Cl.[6] ..... B41J 2/145; B41J 2/05

[52] U.S. Cl. ..... 347/37; 347/44; 347/67

[58] Field of Search ..... 347/37, 40, 44, 347/47, 63, 65, 67

[56] References Cited

U.S. PATENT DOCUMENTS

| | | | |
|---|---|---|---|
| 4,014,029 | 3/1977 | Lane | 347/40 X |
| 4,278,983 | 7/1981 | Halasz | 347/47 |
| 4,312,009 | 1/1982 | Lange | 347/63 X |
| 4,313,124 | 1/1982 | Hara . | |
| 4,330,787 | 5/1982 | Sato | 347/63 |
| 4,345,262 | 8/1982 | Shirato et al. . | |
| 4,450,455 | 5/1984 | Sugitani | 347/45 |
| 4,459,600 | 7/1984 | Sato et al. | 347/56 X |
| 4,463,359 | 7/1984 | Ayata et al. . | |
| 4,558,333 | 12/1985 | Sugitani et al. . | |
| 4,682,188 | 7/1987 | Castellano | 347/49 X |
| 4,712,172 | 12/1987 | Kiyohara | 347/87 X |
| 4,723,129 | 2/1988 | Endo et al. . | |
| 4,740,796 | 4/1988 | Endo et al. . | |
| 5,208,604 | 5/1993 | Watanabe | 347/47 |

FOREIGN PATENT DOCUMENTS

| | | |
|---|---|---|
| 309146 | 3/1989 | European Pat. Off. . |
| 367541 | 9/1990 | European Pat. Off. . |
| 54-056847 | 5/1979 | Japan . |
| 112746 | 7/1983 | Japan . |
| 59-123670 | 7/1984 | Japan . |
| 59-138461 | 8/1984 | Japan . |
| 60-071260 | 4/1985 | Japan . |
| 242852 | 10/1986 | Japan . |

*Primary Examiner*—Joseph Hartary
*Attorney, Agent, or Firm*—Fitzpatrick, Cella, Harper & Scinto

[57] ABSTRACT

An ink jet recording apparatus for recording on a recording material with ink includes an ink jet recording head mounting portion, an ink jet recording head, a base plate, a feeder and a mounting device. The mounting portion is for mounting the recording head. The recording head has ejection outlets converged in a direction of ink ejection and inclined relative to the base plate. The feeder feeds the recording material. The mounting device is for mounting the ink jet recording head on the mounting portion so that the direction of ink ejection from the ink ejection outlets of the recording head is perpendicular to the recording material.

14 Claims, 13 Drawing Sheets

INK JET RECORDING APPARATUS INCLUDING A RECORDING HEAD WITH INCLINED EJECTION OUTLETS

This application is a continuation of application Ser. No. 08/478,095 filed Jun. 7, 1995, now abandoned, which is a continuation of application Ser. No. 08/087,111 filed Jul. 1, 1993, abandoned, which is a continuation of application Ser. No. 07/857,120 filed Mar. 24, 1992, abandoned, which is a continuation of application Ser. No. 07/648,059 filed Jan. 30, 1991, abandoned.

FIELD OF THE INVENTION AND RELATED ART

The present invention relates to an ink jet recording apparatus for effecting recording on a recording material.

Various types of ink jet recording apparatuses are known, including a type wherein a pressure change is produced in a liquid passage by deformation of a piezoelectric element to eject fine droplets of liquid, a type wherein an additional pair of electrodes are used to deflect the liquid droplets, and a type wherein heat is abruptly produced by a heat generating element disposed in a liquid passage to produce a bubble by which a liquid is ejected through an ejection outlet.

Among these types, the ink jet recording apparatus using the thermal energy to eject the recording liquid is particularly noted because of the following advantages:

(1) The liquid ejection outlets (orifices) for ejecting the recording liquid droplets to form flying liquid droplets can be arranged at a high density, and therefore, a high resolution recording is possible;

(2) A recording head provided with the ejection outlets is made compact relatively easily;

(3) The IC technique and micro-machining technique which are remarkably developed with increased reliability in the semiconductor manufacturing field can be used;

(4) The recording head may be in an elongated or two dimensional configuration relatively easily;

(5) A multi-nozzle structure at high density is relatively easily achieved with good productivity in the mass-production and with lower manufacturing cost.

Referring first to FIG. 16, there is shown an ink jet recording head comprising an orifice plate 40 having orifices 41 (ink ejection outlets), a top plate 400 having ink passage grooves 401 in communication with the respective orifices, and a heater board 100 having plural energy generating elements 101 for the liquid ejection and constituting a part of the ink passage.

Generally speaking, the orifice plate is used to constitute the ejection side surface with the same material for the purpose of preventing the deviation of the ejection of the ink droplet attributable to the difference in the wettability between the heater board and the top plate. The orifice is important element influential to the ejection performance of the ink jet recording head. Particularly, the orifice through which the ink is ejected is the most important part. As described hereinbefore, together with the recent development in the image recording technique and the recent development in the recording head manufacturing technique, the size of the orifice (diameter of the orifice) is reduced, and plural orifices are arranged at a high density.

As for the production of the orifice, various developments have been made. The following are examples:

(1) Machining by drill;

(2) Fine processing by electric discharge;

(3) Fine processing by anisotropic etching of Si;

(4) Using photolithography pattern and plating;

(5) Fine processing using $CO_2$ or YAG laser.

The recent demand, described hereinbefore, for the fine images requires that the dimension of the orifice of the ink jet recording head is reduced, and the density of the orifices is increased.

Under the circumstances, the above enumerated methods (1) and (2) are not sufficient to reduce the dimension of the orifice and also to provide sufficient efficiency in the orifice manufacturing.

The method (3) involves problems that the cost of the base material (Si) of the orifice plate is expensive, and that the manufacturing or the processing period is long.

The method (4) involves the problems that the manufacturing period from the photolithography to the plating is long, and that auxiliary materials are required to be used, such as a substrate or photoresist.

The method (5) is not enough to manufacture the satisfactory orifice. The $CO_2$ gas laser and YAG laser do not have the laser output which is sufficient to manufacture, and therefore, the configuration and the accuracy of the produced orifice is not satisfactory. For example, the orifice produced by the YAG laser is not circular, and in addition the material not completely removed by the laser is present around the orifice. Depending on the material and the thickness of the orifice plate, the sufficient opening is not produced.

Using the $CO_2$ gas laser and YAG laser, the orifices are formed one-by-one, and therefore, much time is requires for producing many orifices, so that the method is not suitable for the mass-production.

The plural orifices are required to be formed at the respective correct positions. Using the $CO_2$ gas laser or YAG laser, a moving mechanism for finely moving and finely positioning the laser is required, which increases the difficulties.

As described in the foregoing, the conventional methods involved the respective problems in consideration of the above-described demand.

On the other hand, in order to meet the demands for the finer image formation at higher speed with higher reliability, the improvement has been investigated in the ink. The material of the recording head in contact with the ink, therefore, is required to have sufficient resistivity against the ink. The orifice plate, therefore, is required to have such a property. This may impose further difficulty in the production of the orifices.

As described in the foregoing, the ink jet recording head is comprised of an orifice plate, a top plate and a base plate. If the orifices are not in correct alignment with the corresponding ink passages with high precision, the ejection performance is influenced even to such an extent of the liability of ejection failure.

Since the orifices and the ink passages have very small sizes and are arranged at a high density, and therefore, it is difficult to assemble them with correct alignment, which is an additional problem in manufacturing the ink jet recording head.

These problems would result in the disturbance in the images produced by the recording head, and therefore, low quality images.

SUMMARY OF THE INVENTION

Accordingly, it is a principal object of the present invention to provide an ink jet recording apparatus capable of providing high quality images without image disturbances.

It is another object of the present invention to provide an ink jet recording apparatus in which during the reciprocal scanning movement of the ink jet recording head, the deflection of the ejected ink can be made constant, by which the high quality images are provided.

It is a further object of the present invention to provide an ink jet recording apparatus having high density and fine orifice plates having ejection outlets of a configuration providing excellent ejection performance, wherein the positional relation between the orifice and the ink passage is correct, and therefore, the accuracy in the position at which the ink is ejected is improved, by which the image quality is improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1A:
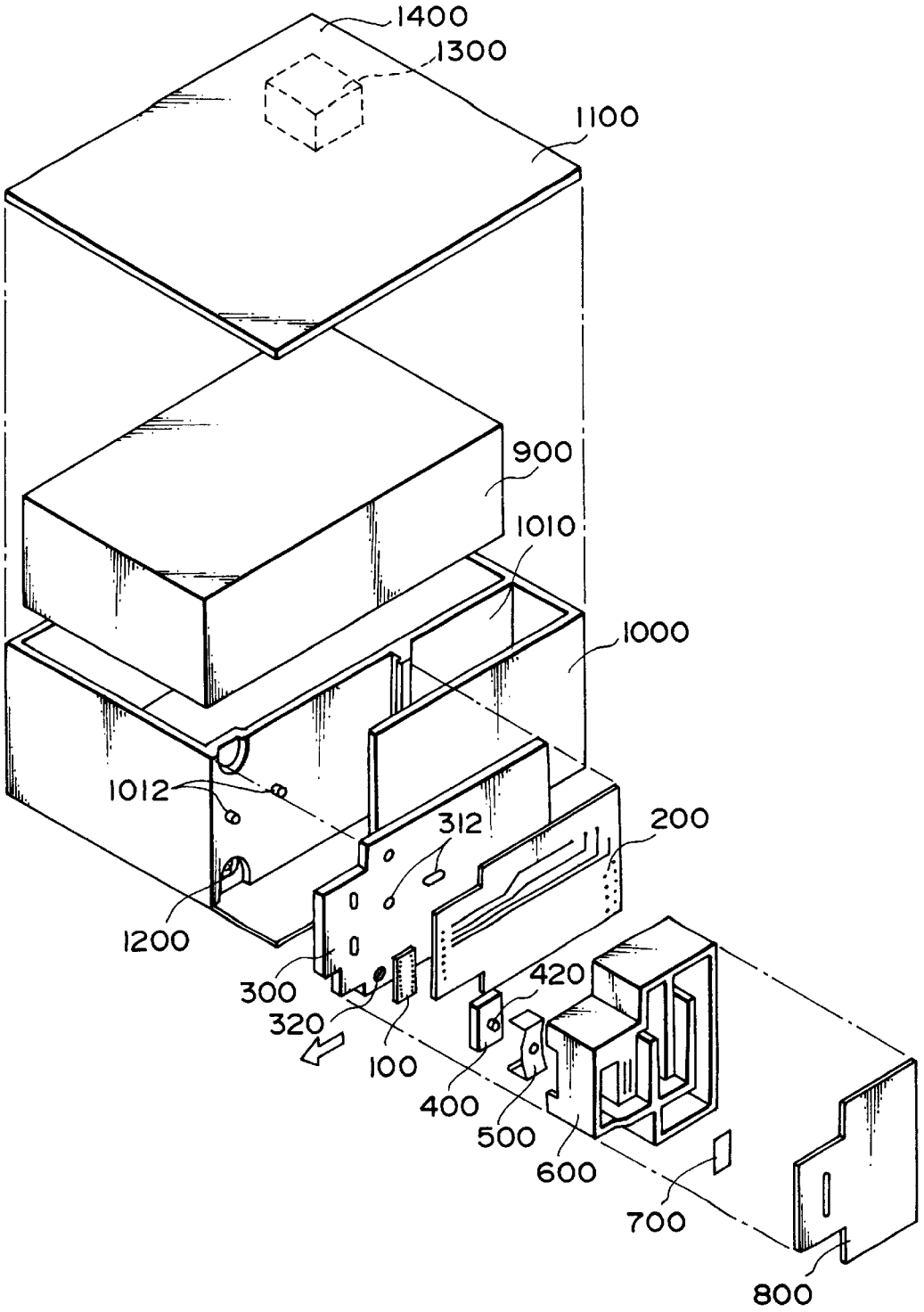
FIGS. 1A and 1B are an exploded perspective view and a perspective view of an ink jet cartridge according to an embodiment of the present invention.
Figure 1B:
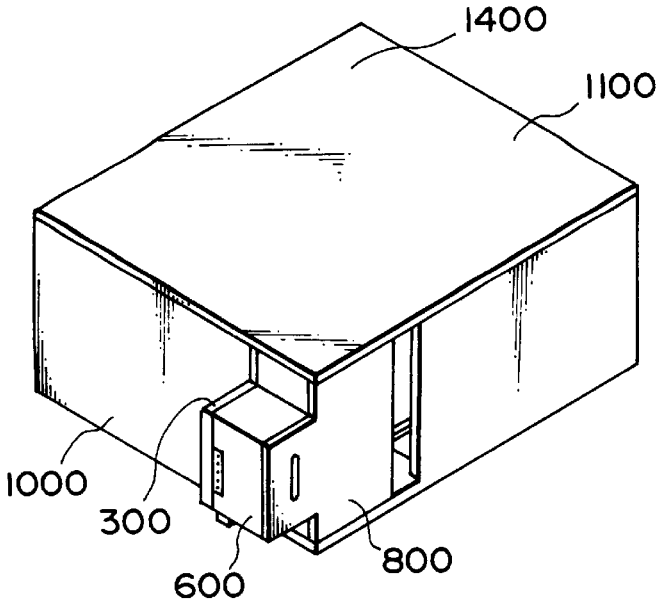

FIGS. 1A and 1B show a recording head according to an embodiment of the present invention. Before describing the embodiment, the general description of the ink jet recording head will be made (European Patent Application No. 89311199.7 assigned to the assignee of this application). The ink jet recording head has as a unit an ink container (ink supplying source) which is detachably mountable to an ink jet recording apparatus.

As shown in FIG. 1A, the recording head comprises a heater board 100 including Si substrate, electrothermal transducers (ejection heaters) and aluminum or the like wiring for supplying electric power to the electrothermal transducers, wherein the electrothermal transducers and the wiring are formed by a film forming technique. It also comprises a wiring board 200 connected to the heater board 100. The corresponding lines are connected by wire bonding or the like.

A top plate 400 has integral portions for constituting partition walls between adjacent ink passages, ejection outlets and a common liquid chamber or the like. It is made of resin material such as polyether sulfone.

A confining spring grips the heater board 100 and the top plate 400 and urges them to each other, thus securing them. The supporting member 300 supports the wiring board 200 bonded thereto. It has a mounting reference relative to a carriage for scanningly moving the recording head. The supporting member 300 also functions as a heat radiating member for emitting heat from the heater board 100, the heat being produced by driving the recording head.

An ink container 600 is supplied with ink from an ink storage element (ink supplying source), and is effective to supply the ink to the common chamber constituted by the bonding between the heater board and the top plate 400. Designated by reference numerals 700 and 800 are a filter disposed in the supply container 606 adjacent an ink supply outlet to the common chamber, and a cover for the ink supply container 600.

An absorbing material 900 for absorbing the ink is disposed in the main body 1000 of the cartridge. An ink supply port 2100 is used to supply the ink into the unit constituted by the above-described parts 100–800. At a proper step before the unit is mounted to the portion 1010 of the main body 1000, the ink is supplied through the supply port 1200, by which the ink is filled in the absorbing material 900.

The cartridge comprises a cover 1100, an air vent formed in the cover for the communication between the inside of the cartridge and the ambience, a liquid repelling material 1300 disposed at the inside of the air communicating vent 1400 which is effective to prevent leakage of the ink through the vent 1400.

Upon completion of the ink supply through the supply port 1200, the unit constituted by the parts 100–300 is mounted to the portion 1010. The positioning or fixing can be accomplished by engagement between projections 1012 of the cartridge main assembly 1000 and holes formed in the supporting member 300, for example. By the combination, the cartridge shown in FIG. 1B is provided. The ink is supplied into the supply container 600 from the cartridge through the supply port 1200, a hole 320 formed in the supporting member 300 and an opening formed in a backside of the supply container 600 (FIG. 1A). From the supply container 600, the ink is further supplied into the common liquid chamber through a suitable supply pipe and an ink inlet 420 of the top plate 400. At the connections of the parts along the ink supply path, gaskets made of silicone rubber or butyl rubber or the like are used to seal the connections.

Figure 2:
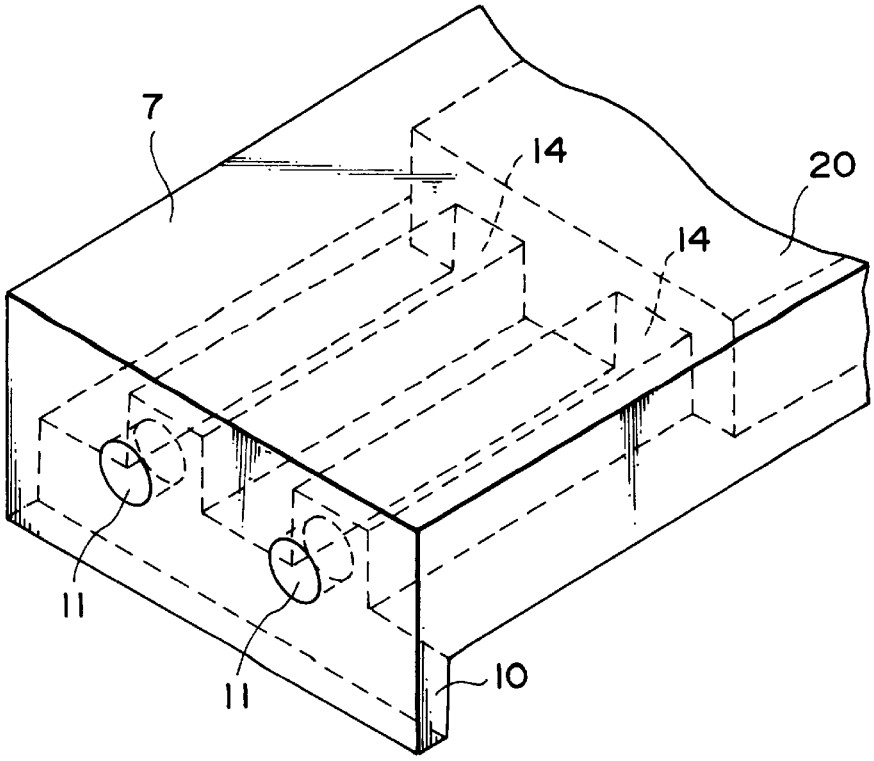
FIG. 2 is a perspective view of a top plate having ink passage grooves and ejection outlets.

FIG. 2 shows the structure of the top plate 7. The top plate 7 has a desired number of ink passage grooves 14 and ink ejection outlets (orifice) 11 formed in the orifice plate 10 which is integral with the top plate 7, although only two orifices are shown for the sake of simplicity.

In the example of FIG. 2, the top plate 7 is made of resin material exhibiting resistivity against the ink, such as polysulfone, polyethersulfone, polyphenylene oxide, polypropylene or the like. The top plate 7 is integrally molded in a mold with the orifice plate 10.

The method of forming the ink passage grooves 14 and the orifices 11 will be described. As for the ink passage grooves, a resin material is molded using a mold having a reverse configuration of the grooves provided by machining or the like. Thus, the grooves 14 are formed in the top plate 7.

As for the production of the orifices, the material is molded in a metal mold into a configuration without the orifices.

Figure 4A:
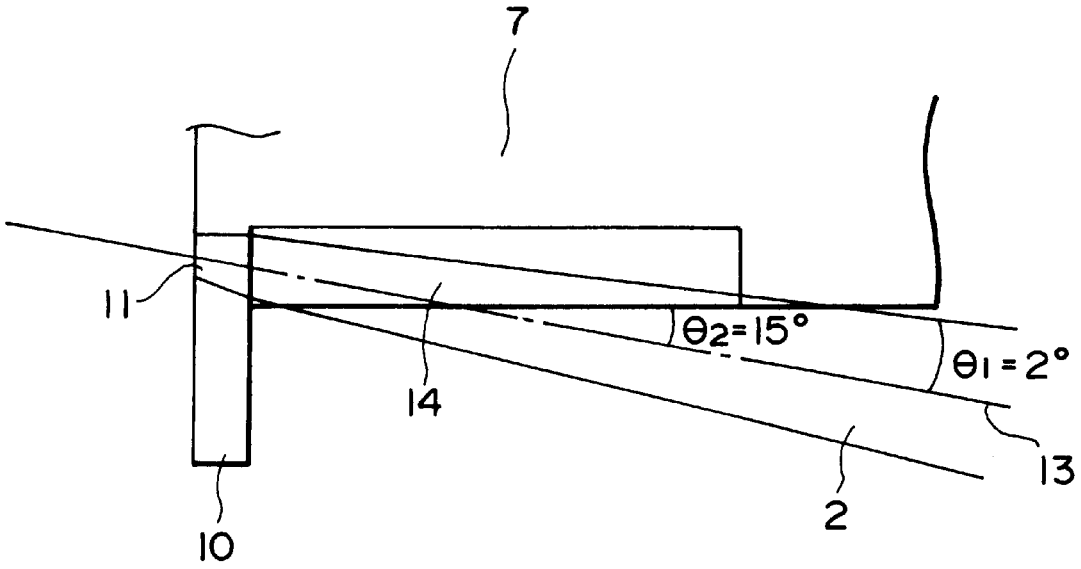
FIGS. 4A and 4B show enlarged views of the laser beam for producing an ejection outlet.
Figure 4B:
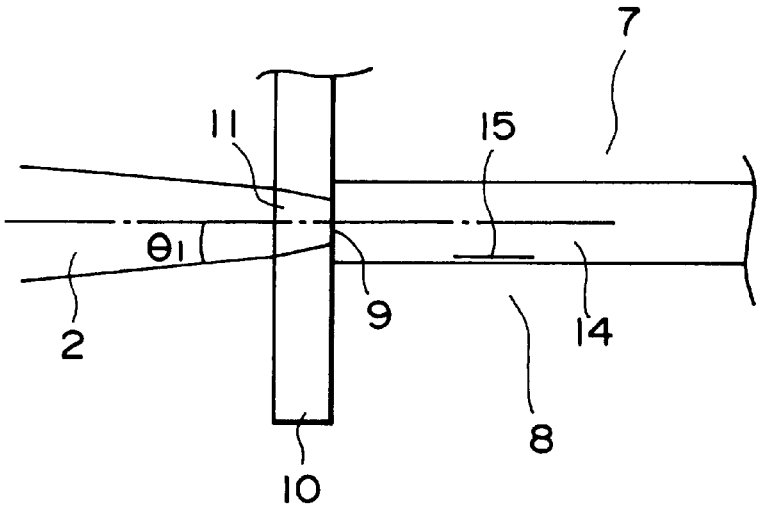

As shown in FIGS. 4A and 4B an excimer laser beam is projected from an excimer laser apparatus to an ink passage side of the orifice plate 10 at a position where the orifice is to be formed. By the application of the excimer laser, the resin material is evaporated and removed to provide an orifice 11.

Figure 3A:
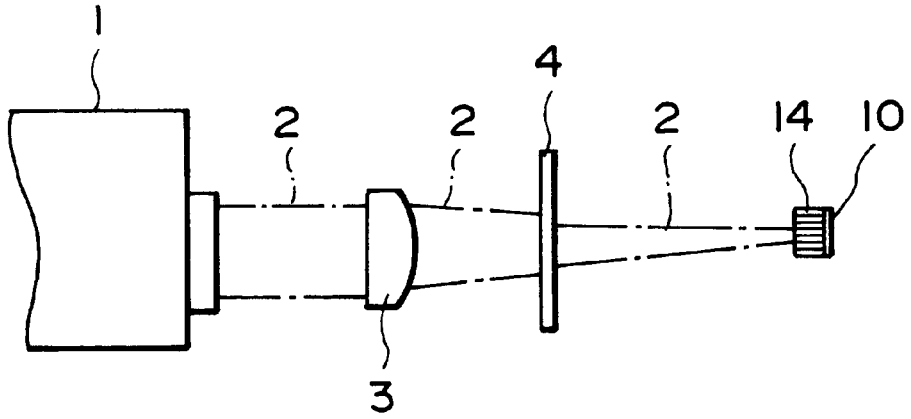
FIGS. 3A and 3B are schematic views of an apparatus for producing an ejection outlet using a laser beam.
Figure 3B:
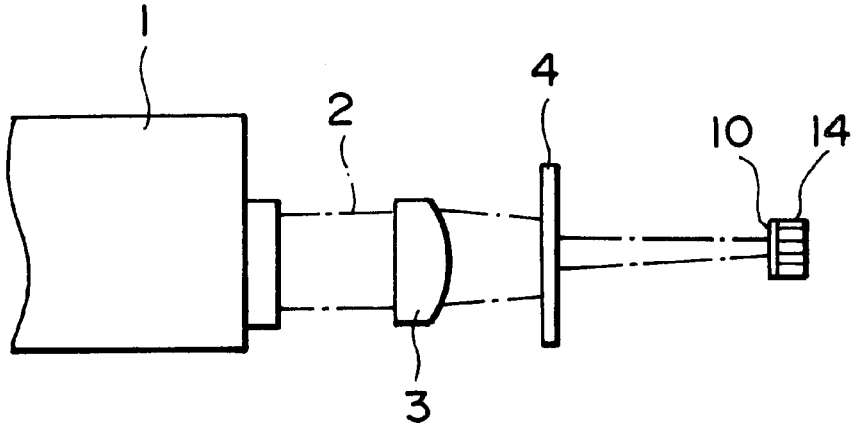

FIGS. 3A and 3B show the orifice formation in an orifice plate integral with the top plate by the application of the excimer laser beam. In FIG. 3A, the laser beam is projected on the inside of the orifice plate 10, that is, to the groove side of the top plate, and FIG. 3B shows the laser beam being projected on the outer side of the orifice plate 10. Both laser beam applications are for forming an ejection outlet. In the Figures, a laser oscillator 1 oscillates KrF excimer laser beam, the laser beam 2 having a wavelength of 248 mm and a pulse width of approximately 14 micro-sec. in the form of pulses. The system comprises a synthetic quartz lens 3 for converging the laser beam 2 onto a projection mask 4 having a pattern of evaporated aluminum capable of blocking the laser beam 2. A plurality of holes having a diameter of 133 microns are arranged at a pitch of 212 microns to constitute a pattern of orifices.

FIG. 4A shows details of orifice production. As will be apparent from this Figure, the excimer laser beam 2 is projected to the orifice plate 10 through the mask 4 to the ink passage side 14. The excimer laser beam 7 is converged at an angle $\theta 1$=1–2 degrees at one side, and the optical axis 13 is inclined at an angle $\theta 2$ of 2–15 degrees from a perpendicular axis of the orifice plate 10.

By applying the laser beam to the inside (liquid passage side), the cross-sectional area of the orifice is tapered and converged toward the ejection direction. Designated by a reference 7 is a top plate having the integral ink passages 14. In this embodiment, the configuration of the ejection outlet is conical with small diameter at the recording sheet side, and the axis of the conical configuration is inclined with respect to a normal line of the ejection plate.

Figure 6:
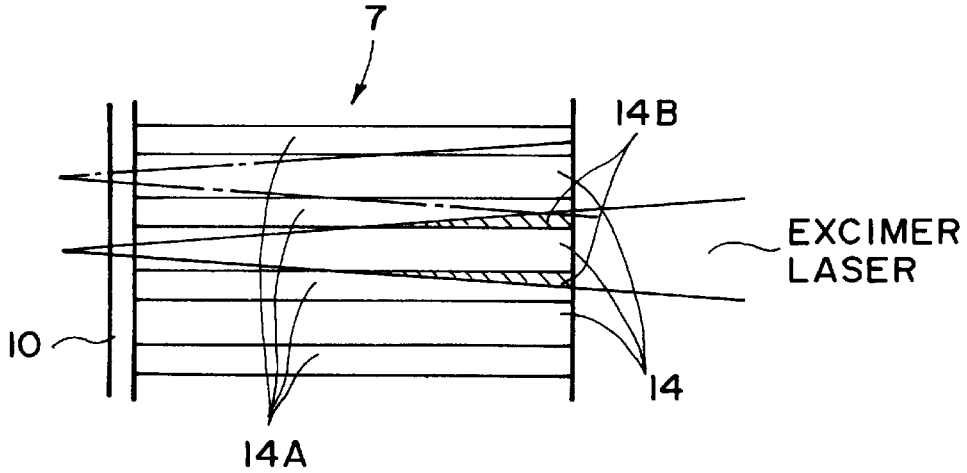
FIG. 6 shows the optical path of the laser for producing the ejection outlet.
Figure 7:
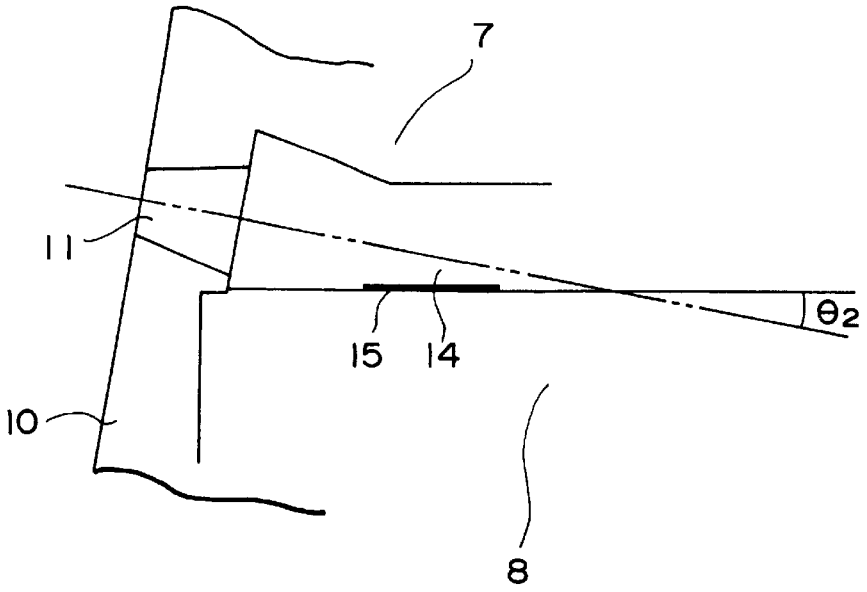
FIG. 7 is an enlarged view adjacent an ejection outlet.

As described, the ink jet head in this embodiment uses an integral top plate having an orifice plate and an ink passage plate, and the ejection outlets are tapered so as to have cross-sectional areas decreasing toward the ejection outlets by the application of the excimer laser beam to the ink passage side of the orifice plate. Therefore, the ejection speed is high, and the orifice surface is not easily wet, so that the ink ejection direction can be stabilized. However, since the excimer laser beam is projected to the inside, a part of the laser beam is blocked by the ink passage wall 14A, as indicated by a reference 14B in FIG. 6, and it is possible that the configuration of the ejection outlet is irregular. As described in the foregoing, the configuration of the ejection outlet is very important and influential to the volume, ejection direction and an ejection speed as well of the ejected ink. In this embodiment, therefore, in order to prevent the blocking of the laser beam by the ink passage groove (wall), the excimer laser is projected with an inclination of 15 degrees with respect to the horizontal surface of the ink passage (the heater board surface during the head manufacturing step), as shown in FIG. 4A. As shown in FIG. 7, the central direction of the tapered ejection outlet (FIG. 7) is inclined by 15 ($\theta 2$) degrees from the heater board surface. In this embodiment, it is inclined by 15 degrees, but the angle of inclination is not limited to this, but can be properly selected by those skilled in the art in accordance with the size of the passage or the like. It may be approximately 5–20 degrees. The cross-sectional configuration of the ejection outlet may be circular, trapezoidal or hexagonal or the like.

According to the manufacturing method shown in FIG. 3B, the orifice cross-sectional configuration is as shown in FIG. 4B. More particularly, the cross-sectional area of the ejection outlet 11 is enlarged in the ejection direction. Here, reference numeral 8 designates a substrate (heater board) on which ejection energy generating elements are patterned; 9 designates an opening communicating with the ink passage; and 15 are electrothermal transducers functioning as ejection energy generating elements.

The description will be made as to the excimer laser beam used in this embodiment. The excimer laser is capable of oscillating ultraviolet laser beam and has advantages of high strength, narrow wavelength, good directivity, short pulse oscillation and capability of being converged by lens to increase the energy density.

By the excimer laser oscillator, the mixture of rare gas and halogen is discharged and excited, by which a short pulse ultraviolet beam (15–35 ns). Kr-F, Xe-Cl and Ar-F lasers are widely used. The oscillation energy is 1000 mJ/pulse, and the frequency of the pulses is 30–1000 Hz.

When the short pulse ultraviolet beam of high strength such as the excimer laser beam is projected on a surface of polymer resin material, the projected portion of the material is instantaneously dissolved and scattered with plasma and impact noise (ablative photodecomposition (APD)). By this, the polymer resin material can be processed.

When the manufacturing accuracy of the excimer laser is compared with that of the other lasers, for example, when the excimer laser, YAG laser and $CO_2$ laser are projected on polyimide (PI) film, a sharp opening is formed by the KrF laser since the ultraviolet light is absorbed by the PI, but the YAG laser not in the ultraviolet region can form an opening, but the edge is not smooth, and in the case of $CO_2$ laser (infrared) results in a crater around the opening.

The excimer laser projection is not influential to metal such as SUS, non-transparent ceramic material or Si, and therefore, such materials are usable as a masking material when the excimer laser is used.

Figure 5:
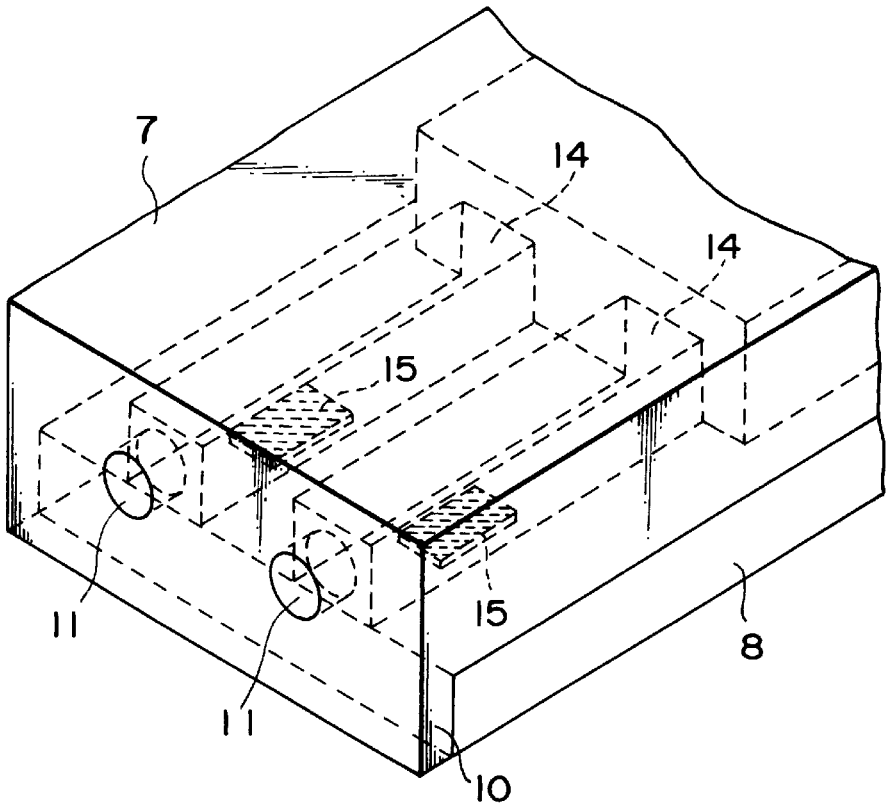
FIG. 5 is a perspective view of a recording head comprising the heater board and a top plate joined therewith.

FIG. 5 is a perspective view of the main body of the recording head constituted by combining the heater board 8 and the top plate 7.

As shown in this Figure, the heater board 8 having the ejection heaters 15 or the like is abutted to the orifice plate 10, and is bonded thereto so as to constitute the main body of the recording head.

In the structure described in the foregoing, the positioning or the bonding between the top plate and the orifice plate is not required, and therefore, the positional deviation or alignment error upon the bonding does not occur. Therefore, the number of rejects and the number of process steps are reduced, which are good from the standpoint of mass-production and the cost reduction of the recording head. In addition, since there is no bonding process between the top plate and the orifice plate, the orifice or the ink passage is free from being clogged with the bonding agent. When the heater board and the top plate 7 having the integral orifice plate 10 are put together, they are correctly positioned in the direction of the passage by abutting the heater board 8 to the end surface which is opposite from the ejection side surface of the orifice plate 10, and therefore, the overall positioning or the assembling steps are easier. In addition, there is no liability of removal of the orifice plate.

The main body of the recording head may be in the form of a cartridge shown in FIG. 1.

Figure 8:
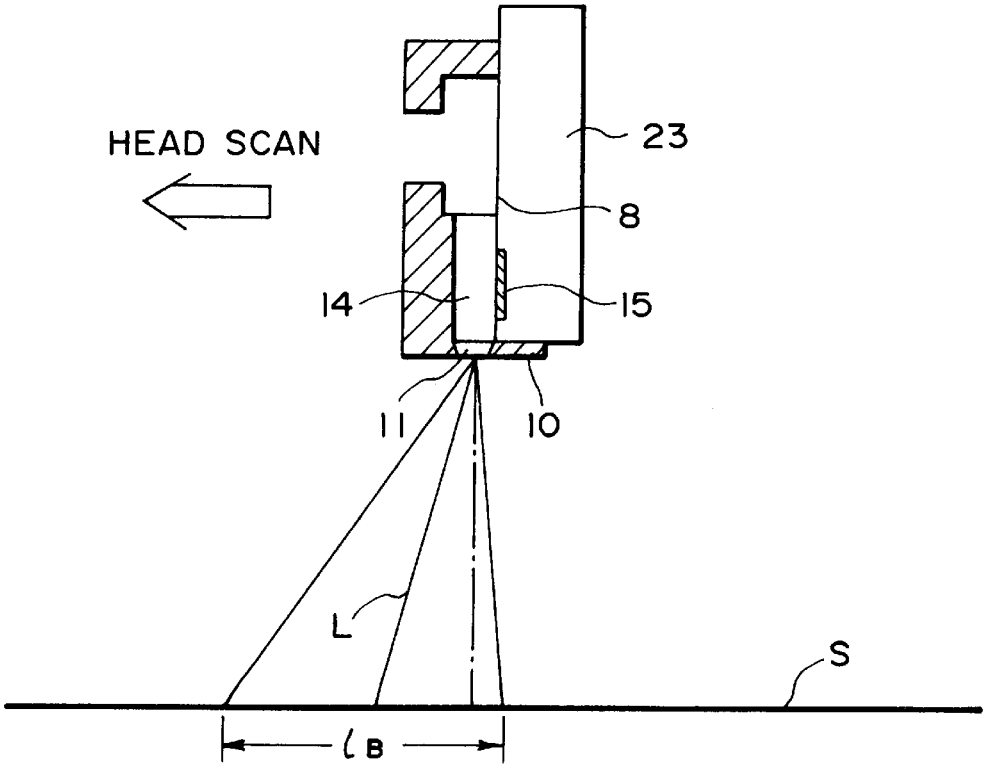
FIGS. 8 and 9 illustrate accuracy of the position of the liquid ejection.

Generally, an ink jet recording head including the recording head of this embodiment involves variation within a range in the amount of ejection, the direction of ejection and the ejection speed. The ejection direction is unstable due to fine foreign matter on the orifice surface, deterioration of the water repelling property or the like. With respect to the orifice made of the same material and in substantially symmetrical configuration as in this embodiment, the ejection direction varies in a conical variation space, as shown in FIG. 8, about the laser beam incidence direction, that is, the central axis of the ejection outlet.

An ink jet recording head in which the variation space is minimized, when the recording head described in the foregoing embodiment is used.

Figure 9:
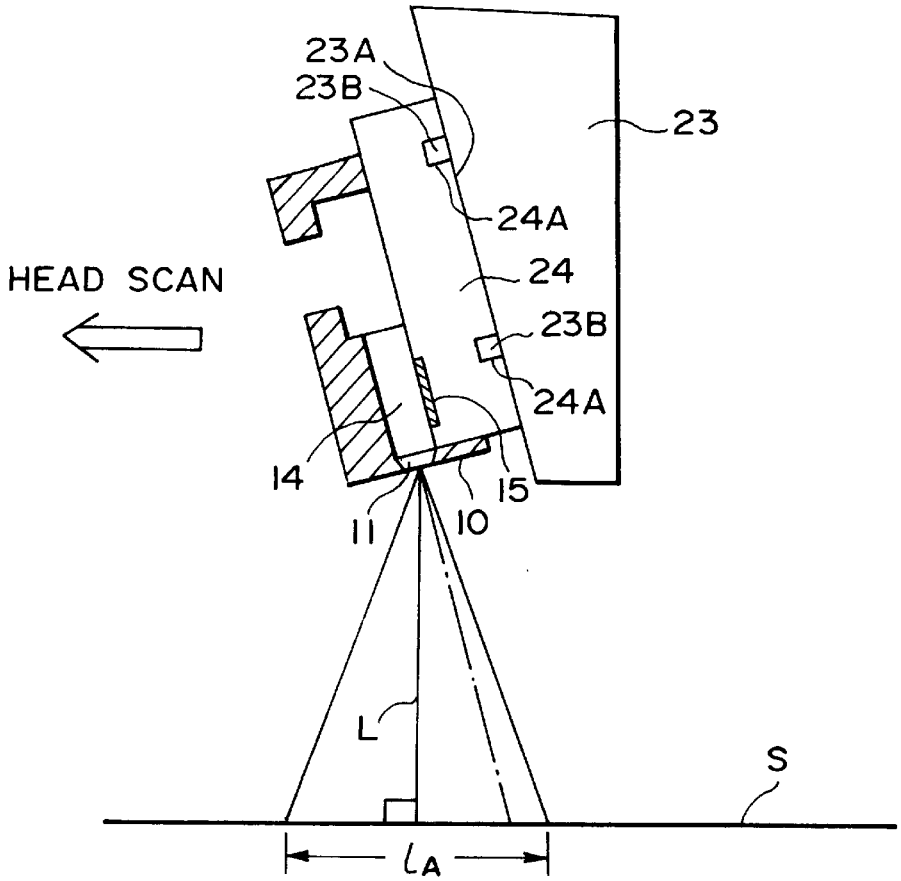

FIG. 9 shows the ink jet recording apparatus of this embodiment.

In this embodiment, a positioning surface of a metal plate 24 which is constructed to be parallel with the heater board and the passage groove of the ink jet head is supported on a head mounting surface 23A of a carriage inclined at the same angle θ2 as the inclination of the above-described laser beam by engagement between projections 23B of the carriage and recesses 24A of the recording head, by which the central direction of the liquid ejection is aligned with a normal direction of the recording material S (FIG. 9). In other words, the recording head is mounted on the head mounting surface 23A of the carriage 23 so that the central line L (incidence direction of the incidence direction of the laser beam) at the ejection outlet and the surface of the recording material S forms 90 degrees angle.

Thus, in this embodiment, in an ejection outlet region controlling the ink ejection direction, the ink ejection direction is changed from the energy supplying direction to the ejection region, and the recording material is disposed so that the distance between the ejection region and the recording material is minimum, and the ink ejection direction is substantially perpendicular to the recording material. The energy supply direction to the ejection region is a pressure wave produced by a bubble formed by film boiling by the thermal energy produced from the electrothermal transducer element. The ejection outlet region is disposed at a vent portion of a member having plural ink guiding recesses, and there are through openings produced by the application of high energy beam at the vent side. The accuracy in the position of shot of the ink on the recording material S is minimum in the head scanning direction, and the ink shot area $l_A$ has the minimum width. Therefore, if the comparison is made between the case in which the head is mounted so that the central line L of the ejection outlet is perpendicular to the recording material S (FIG. 9) and the case in which the heater board 8 and the metal plate 24 are aligned with the normal direction to the recording material S (FIG. 8), the shot area on the recording material S has a smaller width $l_A$ in the former case than in the width $l_B$ in the latter case. By mounting the recording head on the carriage 23 in the manner shown in FIG. 9, the shot accuracy is increased, and therefore, the deflection of the ink is made constant during the reciprocating movement of the carriage. Therefore, even if the recording operation is performed both during the forward and backward movement of the carriage, the sharp images can be obtained in any direction recordings.

In this embodiment, the angle control is effected at the main assembly of the recording apparatus, but it is possible that the metal plate which is a reference surface of the recording head or the positioning portion may be inclined properly. The present invention is applicable to an ink jet recording head which is not of a head exchanging type, but a type wherein only ink is replenished.

Figure 10:
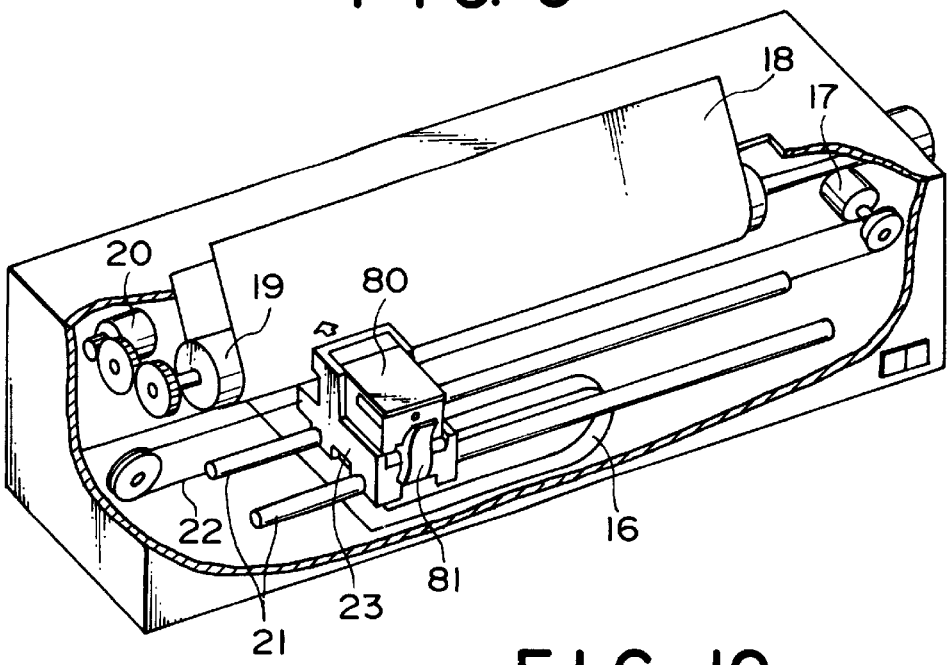
FIG. 10 is a perspective view of an ink jet recording apparatus according to an embodiment of the present invention.

FIG. 10 shows an example of an ink jet recording apparatus in which the recording head is mounted on the carriage under the angular conditions shown in FIG. 9. The ink jet printer of FIG. 9 uses an exchangeable recording head cartridge. The cartridge 80 in FIG. 10 may be the one shown in FIG. 1. The cartridge 80 is detachably mounted on the carriage by a confining member 81. The carriage is reciprocally movable in the longitudinal direction along the shaft 21. The positioning of the cartridge 80 relative to the carriage can be established by holes formed in the cover 300 and projections of the carriage 23. The electric connection therebetween is established by contact between connecting pads on the wiring board and a connector on the carriage 23.

The ink ejected from the recording head of the cartridge 80 is ejected to the recording material 13 which is confined on the platen 19 with a small clearance from the recording head so as to form an image on the recording material 18.

To the recording head, ejection signals in accordance with the image data are supplied from a proper data source through a cable 16 and contacts connected thereto.

In FIG. 10, reference numeral 17 designates a carriage motor for scanningly moving the carriage 23 along the shaft 21, 22 designates wire for transmitting the driving force from the motor 17 to the carriage 23. A feeding motor 20 is connected with the platen roller 19 to feed the recording material 18. The ink jet printer of this embodiment is capable of effecting recording during the forward movement and during the backward movement, of the recording head.

A further embodiment will be described, wherein a cartridge having a recording head 186 having the ejection outlets produced in the similar manner in the foregoing embodiment using the excimer laser, is mounted on an ink jet recording apparatus under the angular conditions shown in FIG. 9.

Figure 11:
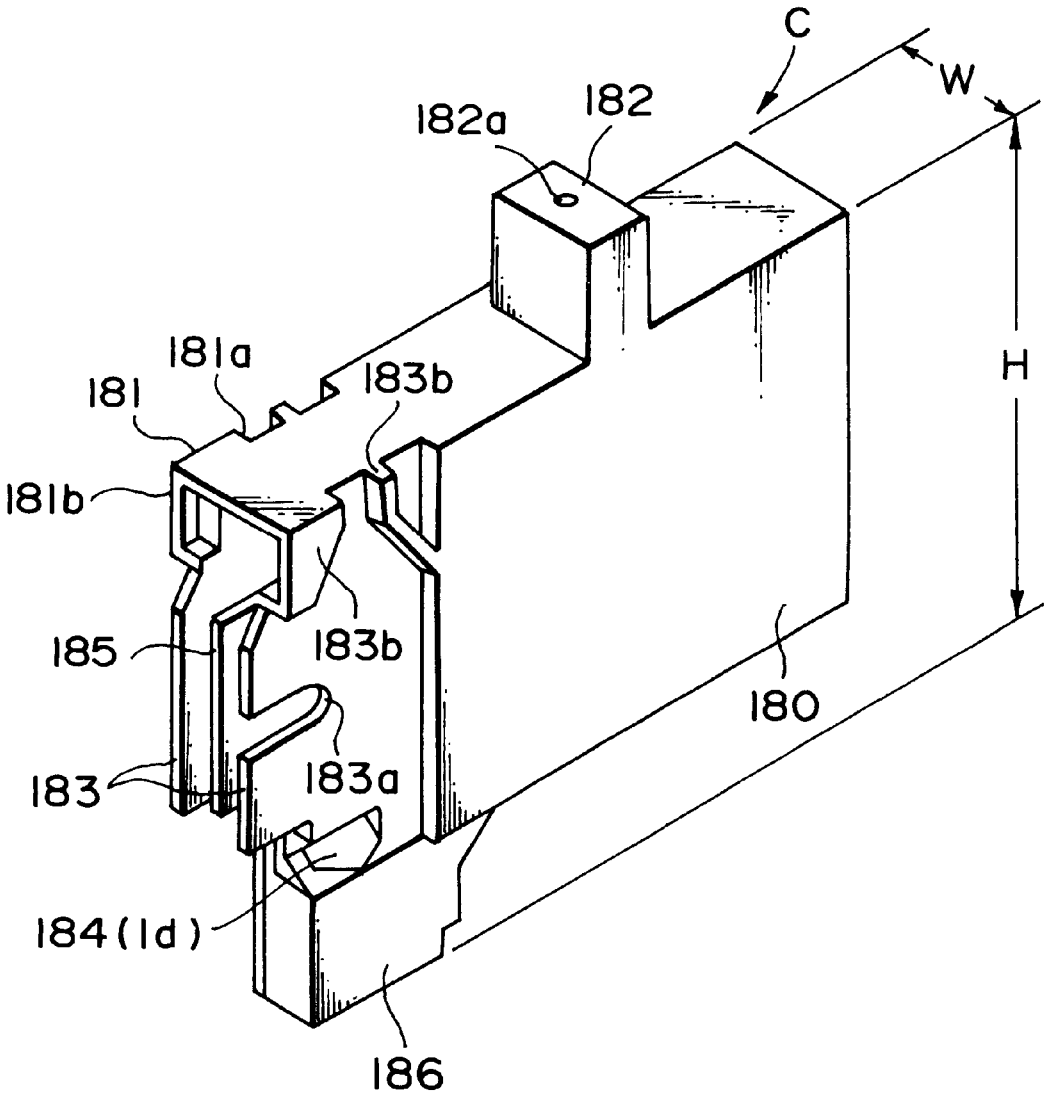
FIG. 11 is a perspective view of a cartridge according to an embodiment of the present invention.

Referring to FIG. 11, an example of the structure of the cartridge C capable of being mounted on a carriage, which will be described hereinafter in conjunction with FIG. 12, of the ink jet recording apparatus according to this embodiment is described. The cartridge C of this embodiment has an ink container and a recording head 186 at the upper and lower positions, respectively. The recording head 186 is produced in the similar manner as in the foregoing embodiment, using the excimer laser beam. The connector 185 of the recording head for receiving signals or the like for driving the recording head 186 and producing an output relating to a remaining amount of the ink is disposed at a position beside the ink container 180. Therefore, when the cartridge C is mounted to the carriage which will be described hereinafter, the height H can be reduced. By reducing the thickness W of the cartridge in the scanning direction, the size of the carriage can be reduced when the cartridge C is disposed beside it, as shown in FIG. 2.

A connector cover 183 is integrally formed with the outer wall of the container to prevent inadvertent contact to the connector 185. A positioning portion 181 has abutment surfaces 181*a* and 181*b* in the two directions. By providing sufficient distances between such positioning surfaces and the positioning abutment surface of the recording head 186, the recording head can be assuredly positioned and fixed by the pressure with a pushing pin toward the slanted surface 184. A grip 182 is used when the cartridge C is mounted or dismounted relative to the mounting position. An air vent 182*a* is formed in the grip 182 to permit communication between the ambience and the inside of the ink container 180. A cut-away portion 182*a* and a guide 183*b* function as guides when the cartridge C is mounted to the mounting portion.

The recording head 186 in this embodiment has plural ejection outlets in the bottom surface of this Figure. In the liquid passages communicating with the ejection outlets, ejection energy generating elements are produced to produce energy contributable to the ejection or discharge of the ink. The ejection energy generating elements are preferably in the form of thermal energy generating elements (electrothermal transducers) from the standpoint that the ejection outlets or the ejection outlets can be disposed at a high density.

Figure 12:
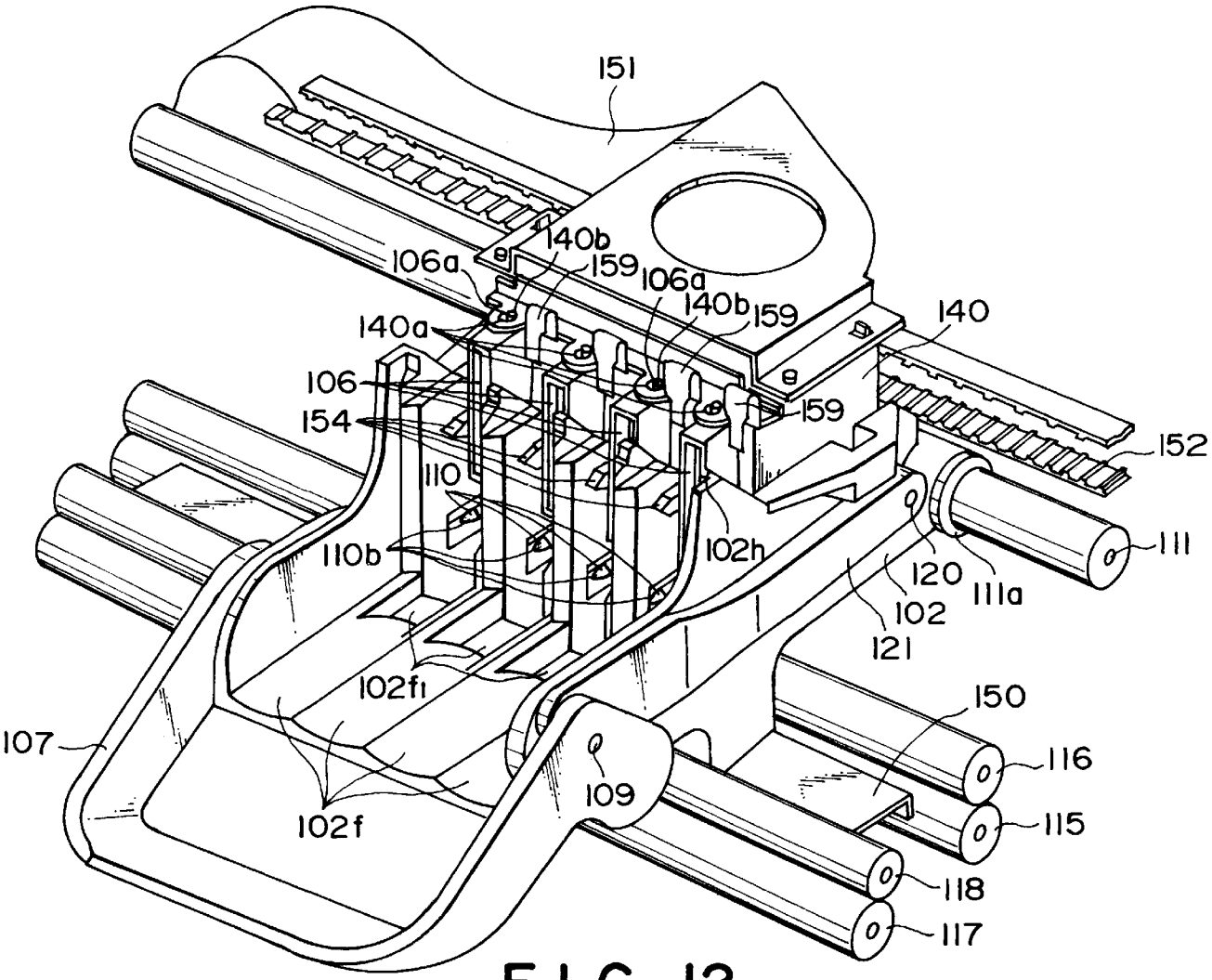
FIG. 12 is a perspective view of an ink jet recording apparatus according to an embodiment of the present invention.
Figure 13:
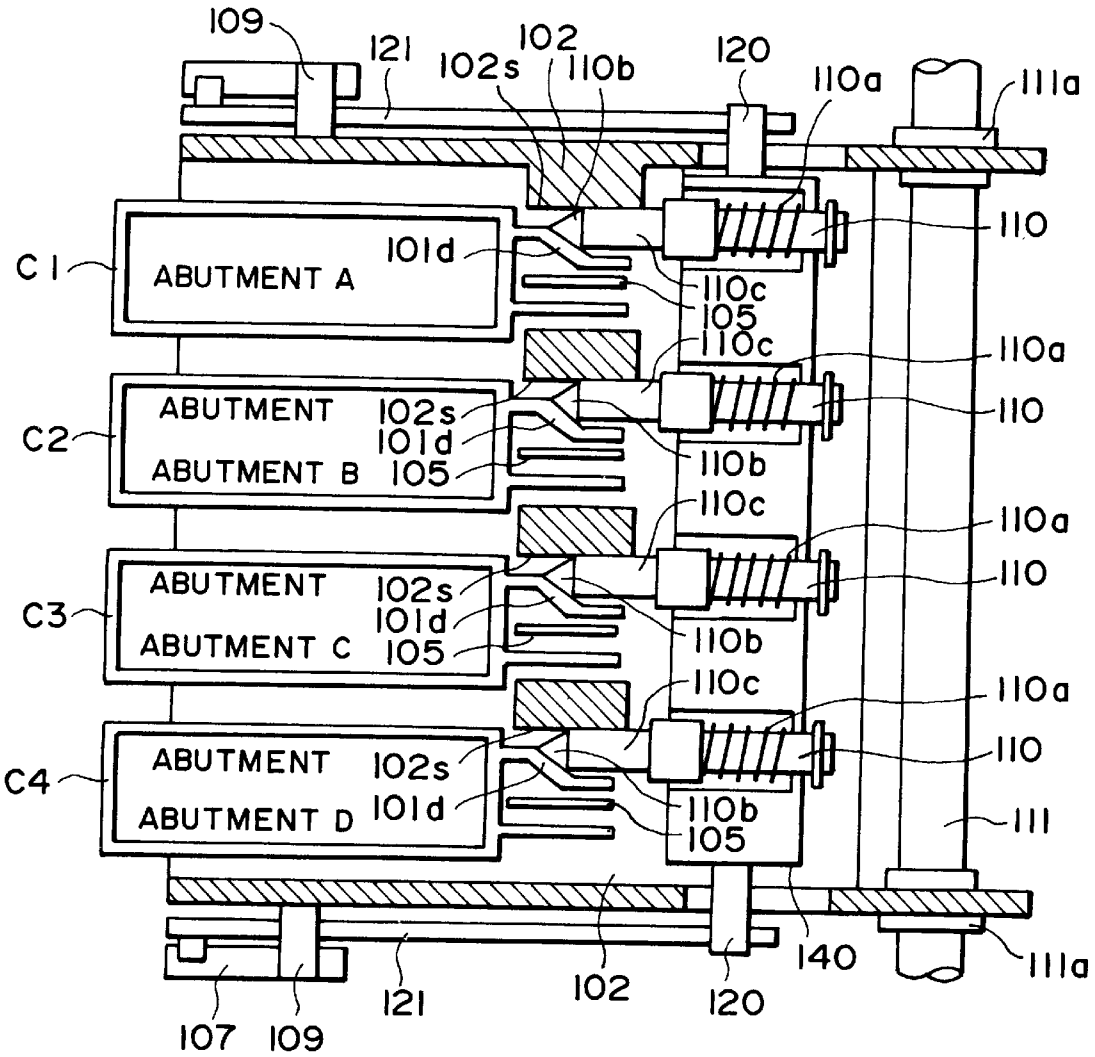
FIG. 13 is a top plan view of the ink jet recording apparatus of FIG. 12.

FIGS. 12 and 13 are a perspective view and a top plan view of the carriage of the ink jet recording apparatus for mounting the cartridge C shown in FIG. 11 under the condition shown in FIG. 9. In these Figures, four cartridges C1, C2, C3 and C4 are mounted on the carriage 102. The cartridges contain different color ink material, yellow ink, magenta ink, cyan ink and black ink, for example. To the connector holder 140, four pushing pins 110 (A–D) are engaged and are urged to the left in FIG. 13 by springs 110*a* (A–D). The connector holder 140 functioning as a supporting member is engaged with links 121 (link I and link II) through a shaft 120 (shaft I and shaft II) and is movable to the left and right in accordance with rotation of an operating lever 107 engaging with the rink 121 (clockwise direction and counterclockwise direction). When it is moved to the right, the pressure is released to permit exchange of the cartridge, and when it moves to the left, the mounting of the cartridge is permitted.

When the cartridge C is mounted to the mounting portion 102*f*, the recording head 186 of the cartridge C is inserted from the upper direction to a front recess 102*f*1 of the mounting portion 102*f*. At this time, a rectangular portion 102*h* of the carriage 102 is engaged between guides 183*b* of the cartridge C, so that the cartridge C is roughly positioned. When the operating lever 107 is rotated in the clockwise direction about the shaft 109, the holder 140 advances, so that the cut-away portion 183*a* of the cartridge C is advanced to the guide 154 of the carriage 102, and the pin 110 is engaged with the cartridge C, by which the cartridge C is mounted to the mounting portion 102*f*. At this time, the angular relation between the recording head and the recording sheet is as shown in FIG. 9. A spring 159 is provided on the carriage 102 to produce urging force to improve the positioning accuracy of the cartridge C by backwardly pushing the cartridge C mounted on the mounting portion 102*f*. The free end 110*b* of the pushing rod 110 is contacted to the associated one of the four cartridges C at the abutment surface 101*d* to push the cartridge. An outer peripheral surface 110*c* of the pushing pin 110 is contacted to an abutment surface 102S of the carriage 102 to independently receive the thrust force perpendicular to the axis of the pushing pin. Therefore, the supporting member 140 receives only the reaction force by the spring 110*a* (springs A–D), and does not receive the thrust force. Therefore, when the plural cartridges are simultaneously released, the releasing operation can be carried out with small operating force to the releasing lever 107.

The description will be made as to the structure and operation for engagement and disengagement between the head connector 185 of the cartridge C and the connector (main assembly connector) 106 of the main apparatus for the connection with the head connector 185.

Figure 14:
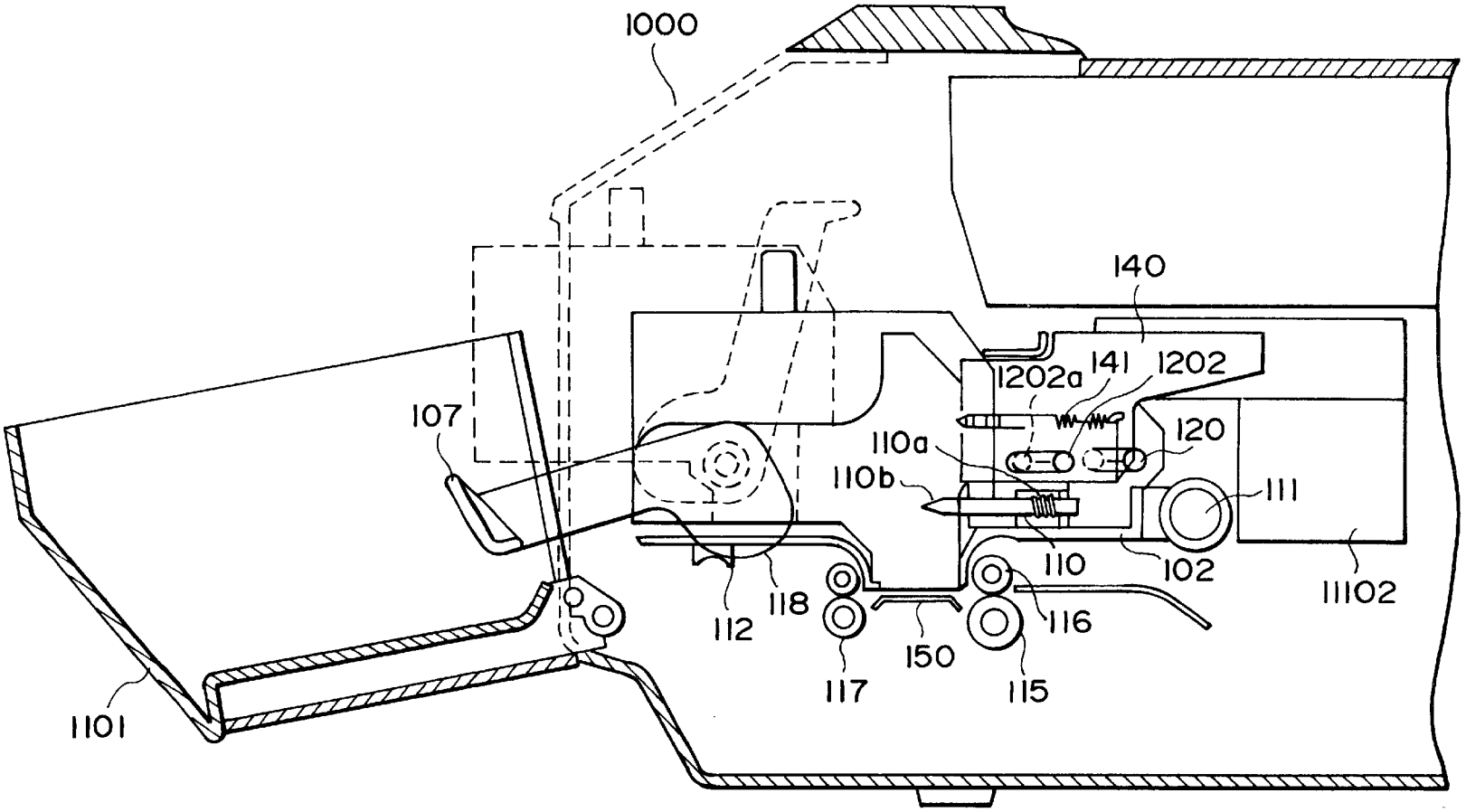
FIGS. 14 and 15 are side sectional views.

When the connector 106 is inserted to the head connector 185, the following operation is performed. The lever 107 is operated when an engaging shaft 106*a* integral with the main assembly connector 106 is engaged with an engaging hole 140*b* of the connector holder 140 by resilience force of the tension spring 141 (FIG. 14). Then, the main assembly connector 106 and the connector holder 140 move as a unit. A head connector 185 having been roughly positioned by the mounting of the cartridge C to the mounting portion 102*f* of the carriage 102, and the main assembly connector 106 which has been roughly positioned by the engagement between the engaging shaft 106*a* and the engaging portion 140*b*, meet together, and are guided by an unshown slanted surface of the main assembly connector 106, until the main assembly connector 106 is engaged (combined) with the head connector 185. Thereafter, the connector holder 140 moves to the right through a predetermined distance l toward rear in FIG. 12, by rotation of the lever 107. The predetermined distance is the distance between the engaging shaft 106*a* and the engaging portion 140*b*, and a movement distance of the connector holder 140 permit (release) movement of the main assembly connector 103 from the positioned state.

Since the main assembly connector 106 is combined with the head connector 85 with force stronger than that of the tension spring 141. The main assembly connector 106 is released from the connector holder 140. That is, the disengagement occurs. A large diameter portion of the engaging hole 140*a* is larger in the diameter than the engaging shaft 106*a* of the main assembly connector 106 and therefore, a gap appears therebetween. Accordingly, upon the engagement between the main assembly connector 106 and the head connector 185, the main assembly connector 106 is free from the connector holder 140, and therefore, the cartridge C is positioned relative to the carriage 102 only by the pressing force of the pressing pin 110, by which the correct positioning of the recording head 186 relative to the carriage 102 is assured.

When the cartridge C is dismounted (released), the lever 107 is rotated in the counterclockwise direction from the upright position to the horizontal position (FIG. 12). At the initial stage, the engaging shaft 106*a* is engaged with the heat connector 185 with strong force, but together with the rightward movement of the connector holder 140, the large diameter surface of the engaging hole 140*a* abuts the engaging shaft 106*a*, and releases the main assembly connector 106 from the head connector 108 while pushing the engaging shaft 106*a* toward rear in FIG. 12. Simultaneously, the pushing pin 110 moves together with the connector holder 140 and is moved away from the recording head 186.

In FIGS. 12 and 13, a scanning rail 111 extends in the main scan direction of the carriage 102 and slidably supports the carriage. Designated by a reference numeral 111*a* is a bearing. A flexible cable 151 functions to transfer various signals to the cartridge C through the connector. A belt 152 functions to transmit the driving force for reciprocating the carriage 102. Pairs of rollers 117 and 118, 115 and 116 are effective to feed the recording material and are disposed before and after the recording position by the recording head 186. A platen 150 is effective to provide a flat recording surface of the recording material.

FIG. 14 shows the recording apparatus in the form of a printer, copying machine or facsimile machine, using the above-described structures.

The main assembly 1000 of the recording apparatus is provided with a cover 1101 openable at the front side. When the cover 1101 is opened, the inside of the main assembly becomes accessible. In addition, the opening of the cover permits the rotational movement of the lever 107 to permit mounting or dismounting of the cartridges C1, C2, C3 and C4 relative to the main assembly. The lever 107 indicated by the solid line is at the position for permitting mounting of the cartridge shown in FIG. 11. At this position, the movement of the cover 1101 to the closed position is prevented. The position of the cartridge shown by the broken lines is the position during the mounting operations. The cartridge position shown by the solid lines is a recordable operating position in the main assembly of the apparatus. The ejection side surface of the recording head 186 of the cartridge is parallel with the guiding surface of the platen 150, and the recording head is projected from the carriage to the bottom to be interposed between the feeding rollers 116 and 118. Reference numeral 1102 designates a flexible sheet for the electric wiring. A rail 112 cooperates with the rail 111 to support and guide the carriage 102.

The connector holder 140 is shown as after the cartridge is fixed to the carriage by moving the lever 107 to its broken line position after the cartridge is mounted. Shafts 120 and 1202 are provided at both sides relative to the relative movement between the connector holder 140 and the carriage, and the positional levels are the same. The shafts are columnar for permitting movement in the two elongated holes having central long axes to the sides of the carriage. The shaft indicated by the solid lines correspond to the lever 107 indicated by the solid lines. The shafts 120 and 1202 further assure the parallel movement of the connector holder. In this embodiment, the shafts 120 and 1202 are provided on other than the connector main body, and are disposed above and adjacent the pushing pin 110 for positioning the recording head, and therefore, the positioning accuracy of the pushing pins 110 is increased. Shafts similar to the shafts 120 and 1202 may be provided on the main assembly of the connector to stabilize the parallel movement of the connector main body, and after the connection of the connector it may be freed in the front-rear direction and in the lateral direction within the clearance from the side plate. In this embodiment, it is preferable that the elongated slot of the shaft 1202 does not fix the shaft 1202 in the front-rear direction after the connector main body is connected, by which the positioning of the pin 110 acts only on the shaft 120.

Figure 15:
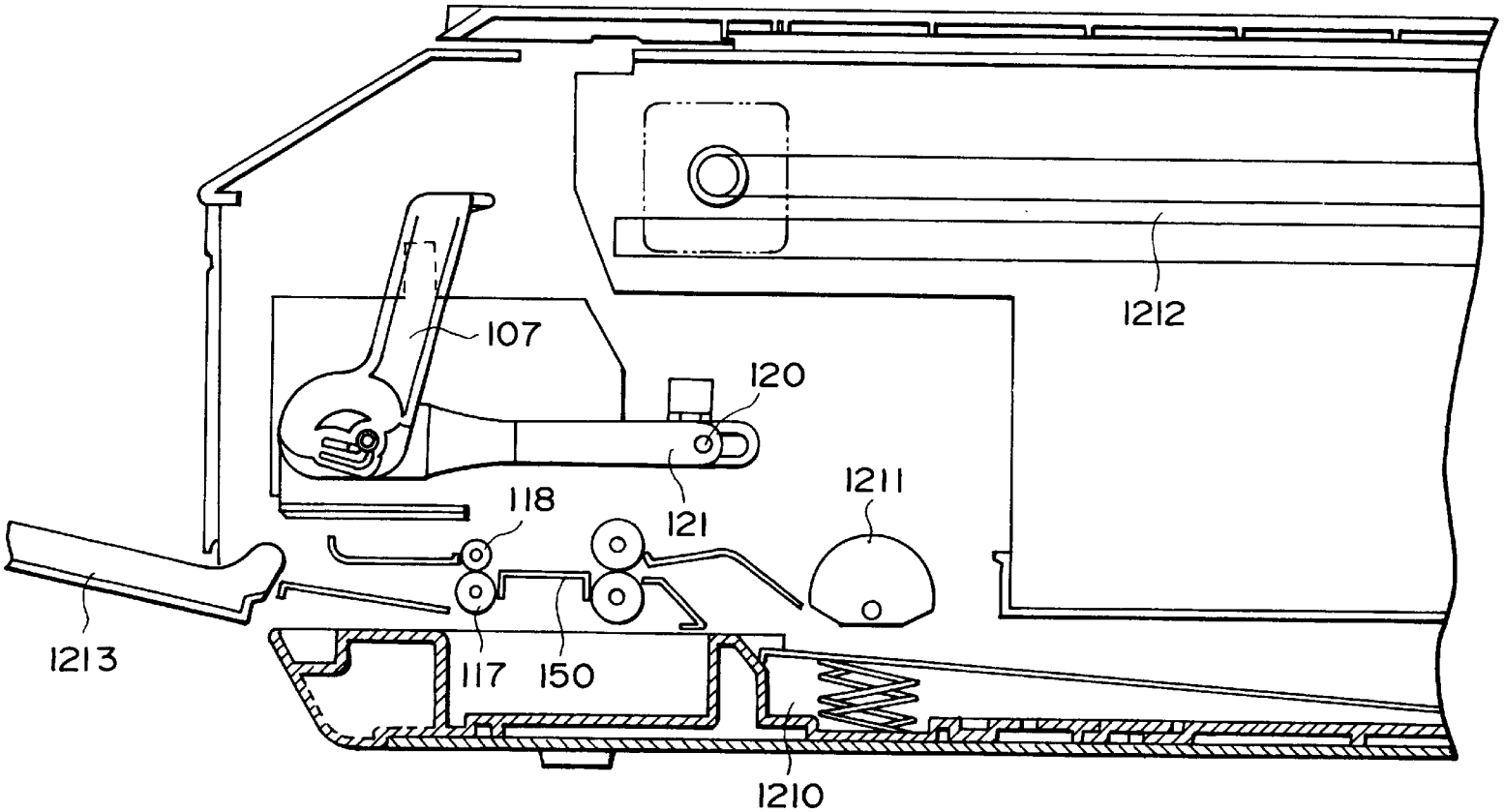
Figure 16:
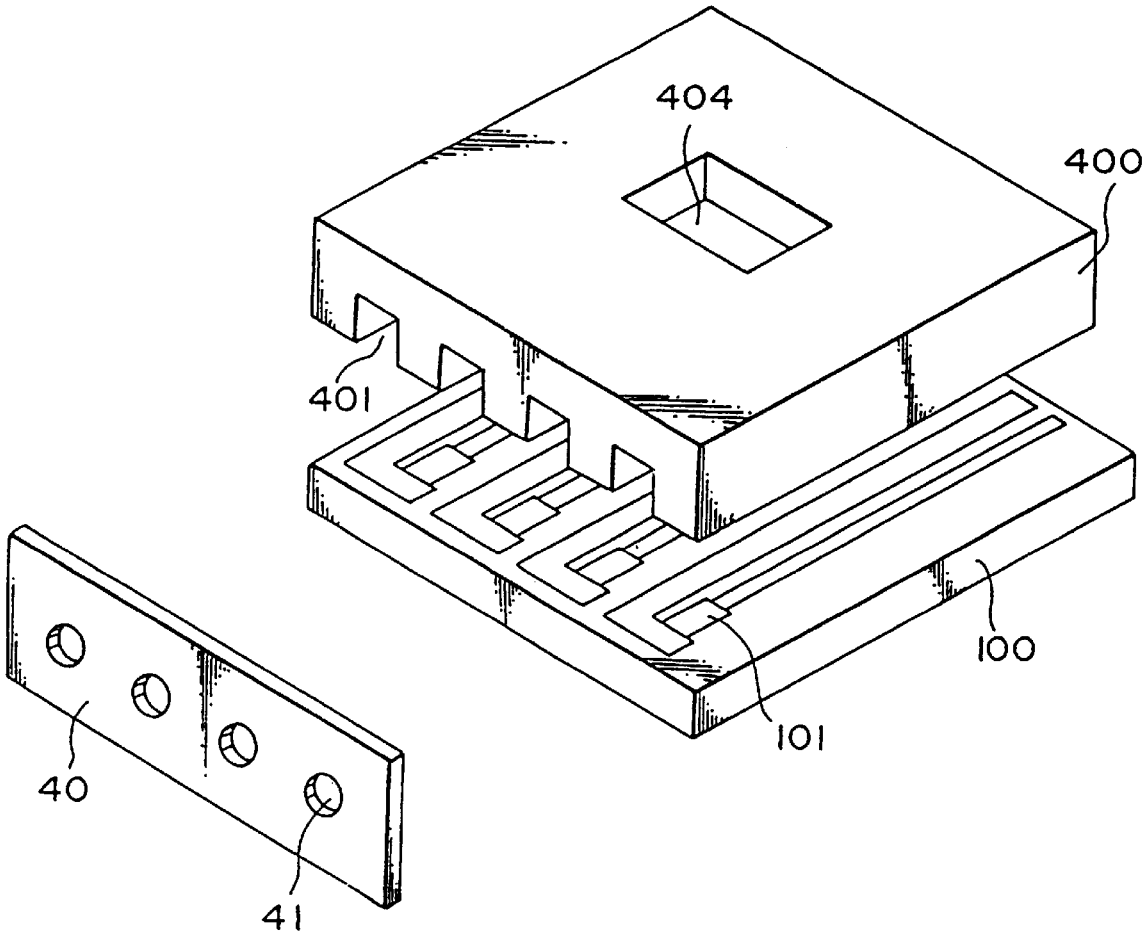
FIG. 16 PRIOR ART
FIG. 16 is an exploded view of a conventional recording head.

FIG. 15 is a side view illustrating the engaging relation between the lever 107 and the shaft 120, and corresponds to a side view of the apparatus shown in FIG. 13. As described in conjunction with FIG. 13, the link 121 engages the lever 107 with the shaft 120. In this Figure, the main assembly is used as a copying machine. The structure will be briefly described. As shown in the Figure, there are an upper original cover, an optical reading means disposed below an original supporting platen glass, and means 1212 for converting the read information to electric signals. The electric signals are converted to recording head driving signals through the flexible sheet 1102 to produce a full-color ink image. A cassette 1210 is inserted into the bottom portion of the main assembly from a discharge tray 1213 side to supply the recording material in the direction opposite from the inserting direction. A feeding roller 1212 is provided in the recording material feeding station.

In the ink jet recording apparatus in this embodiment, the recording head is mounted on the carriage in the positional relation having been described in conjunction with FIG. 9, and therefore, good recording is possible both during the forward movement and during the backward movement, of the recording head.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or suction means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is applied and is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the top plate has an integral orifice plate, and the excimer laser beam is applied from the inside at such an angle that the wall constituting the groove is not influential to the excimer laser beam, by which an ink ejection or discharge outlet is formed. Upon the mounting of the ink jet head to the main assembly of the recording apparatus, the recording head is inclined at the same angle as the inclination of the laser beam. Therefore, a tapered ejection outlet can be stably provided, and the ejection direction is stabilized. In addition, during the recording operation, the accuracy of the position of the ejected liquid is improved.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus for recording with ink on a recording material supported on a surface of a platen, said apparatus comprising:

an ink jet recording head having an ejection outlet and a base plate, with the election outlet being converged in a direction of ink election and inclined relative to a surface of the base plate;

and a recording head mounting portion, having a mounting surface, for mounting the ink jet recording head on the mounting surface, said mounting portion being movable in a moving direction along the recording material supported by the platen, wherein said mounting surface is inclined relative to the moving direction of said mounting portion, and the inclination is such that a direction of election of the ink is substantially perpendicular to the surface of the platen.

2. An apparatus according to claim 1, wherein the base plate is a heater board, and the ejection outlet is inclined relative to the heater board by approximately 5–approximately 20 degrees.

3. An apparatus according to claim 1, wherein the ejection direction is the same as a direction of a laser beam used when the recording head is produced.

4. An apparatus according to claim 1, wherein the ejection outlet is formed on a top plate having an integral ejection outlet plate by projecting a laser beam at such an angle that the laser beam is not interfered by a part of the top plate.

5. An apparatus according to claim 1, wherein said ejection outlet is tapered toward inside in the ink ejection direction.

6. An apparatus according to claim 1, wherein said mounting portion has a carriage reciprocable in a predetermined direction.

7. An apparatus according to claim 1, wherein the recording head is reciprocable and effects recording both during a forward movement and during a backward movement, thereof.

8. An apparatus according to claim 1, wherein said mounting means detachably mounts the ink jet recording head thereon.

9. An apparatus according to claim 1, wherein the ink jet head has an electrothermal transducer for producing thermal energy to eject the ink by thermal energy.

10. An ink jet recording apparatus according to claim 1, further comprising an ejection outlet plate having the ejection outlet, wherein the ejection outlet has a size which is smaller at a side of the ejection outlet plate adjacent the recording material than an opposite side, and the ejection outlet is inclined relative to a line perpendicular to the ejection outlet plate.

11. An apparatus according to claim 10, wherein the ejection outlet is a through opening formed by projection of a high density beam to an ink passage side of the ejection outlet plate.

12. An apparatus according to claim 11 or 10, wherein said ink jet recording head comprises an electrothermal transducer element.

13. An apparatus according to claim 12, wherein the electrothermal transducer element is supplied with electric energy to form a bubble by film boiling to eject the ink by ejection energy in the form of a pressure wave resulting from production and contraction of the bubble.

14. An ink jet recording apparatus for effecting recording by ejection of ink onto a recording material, said apparatus comprising:

a base plate having plural ejection energy generating elements for producing ejection energy to eject the ink;

a grooved plate having plural grooves for cooperation with said base plate to provide ink passages corresponding to said ejection energy generating elements and having an integral ejection outlet forming portion in which ejection outlets are formed in communication with said ink passages by projection of a laser beam to a side of said ejection outlet forming portion closer to said ink passages and are inclined relative to a surface of said base plate;

a platen having a surface for supporting the recording material at a position opposite to the ejection outlets; and mounting means for mounting said base plate and said grooved plate, said mounting means being movable along the recording material and having a mounting surface inclined relative to a moving direction of said mounting means, and said mounting surface carries said base plate and said grooved plate so that the ink ejection direction from said ejection outlets is perpendicular to the surface of said platen.

* * * * *